US011584132B2

(12) United States Patent
Nagai et al.

(10) Patent No.: US 11,584,132 B2
(45) Date of Patent: Feb. 21, 2023

(54) LIQUID STORAGE CONTAINER

(71) Applicant: CANON KABUSHIKI KAISHA, Tokyo (JP)

(72) Inventors: Noriyasu Nagai, Tokyo (JP); Ryoji Inoue, Kanagawa (JP); Kyosuke Nagaoka, Tokyo (JP); Takayuki Tanno, Tokyo (JP); Kenta Udagawa, Tokyo (JP); Hideaki Matsumura, Kanagawa (JP); Taiji Maruyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/370,948

(22) Filed: Jul. 8, 2021

(65) Prior Publication Data

US 2022/0016893 A1 Jan. 20, 2022

(30) Foreign Application Priority Data

Jul. 16, 2020 (JP) ..... JP2020-122025

(51) Int. Cl.
*B41J 2/175* (2006.01)

(52) U.S. Cl.
CPC ..... *B41J 2/17509* (2013.01); *B41J 2/1754* (2013.01); *B41J 2/17513* (2013.01); *B41J 2/17523* (2013.01)

(58) Field of Classification Search
CPC .... B41J 2/175; B41J 2/17506; B41J 2/17509; B41J 2/17513; B41J 2/17523; B41J 2/1754; B41J 2/17596; B41J 29/02; B41J 29/13
See application file for complete search history.

(56) References Cited

U.S. PATENT DOCUMENTS 5,732,751 A * 3/1998 Schmidt ..... B41J 2/17506 141/2
6,145,972 A 11/2000 Udagawa et al. ..... 347/86
(Continued)

FOREIGN PATENT DOCUMENTS

CN 2910576 Y 6/2007
CN 104070821 10/2014
(Continued)

OTHER PUBLICATIONS

U.S. Appl. No. 17/370,942, filed Jul. 8, 2021.
(Continued)

*Primary Examiner* — Anh T Vo
(74) *Attorney, Agent, or Firm* — Venable LLP

(57) ABSTRACT

A liquid storage container includes: a discharge port member including a discharge port through which liquid stored in a storage portion is discharged; a cover portion configured to be attachable to and detachable from the discharge port member and to be capable of opening and closing the discharge port; a liquid stop valve provided inside the discharge port member; and a protrusion provided inside the cover portion and configured to open the liquid stop valve in closing the cover portion. In the liquid storage container, the storage portion is sealable by at least one of a first sealing portion formed of a contact portion between the cover portion and the discharge port member and a second sealing portion formed of the liquid stop valve, and the first sealing portion and the second sealing portion are configured to be simultaneously unsealed.

13 Claims, 10 Drawing Sheets

(56) References Cited

U.S. PATENT DOCUMENTS

| | | | | |
|---|---|---|---|---|
| 6,244,695 | B1 | 6/2001 | Udagawa | 347/86 |
| 6,382,786 | B2 | 5/2002 | Iwanaga et al. | 347/86 |
| 6,416,173 | B2 | 7/2002 | Kishida et al. | 347/86 |
| 6,419,349 | B1 | 7/2002 | Iwanaga et al. | 347/86 |
| 6,527,381 | B1 | 3/2003 | Udagawa et al. | 347/86 |
| 6,652,949 | B2 | 11/2003 | Iwanaga et al. | 428/65.9 |
| 6,742,881 | B2 | 6/2004 | Kotaki et al. | 347/86 |
| 7,290,861 | B2 | 11/2007 | Inoue et al. | 347/49 |
| 7,311,388 | B2 | 12/2007 | Ogura et al. | 347/87 |
| 7,434,921 | B2 | 10/2008 | Udagawa | 347/85 |
| 7,503,469 | B2 * | 3/2009 | Bloom | B65D 47/2031 222/212 |
| 7,735,984 | B2 | 6/2010 | Iijima et al. | 347/86 |
| 7,784,927 | B2 | 8/2010 | Inoue et al. | 347/86 |
| 7,854,499 | B2 | 12/2010 | Udagawa | 347/86 |
| 7,950,790 | B2 | 5/2011 | Kubo et al. | 347/86 |
| 8,002,397 | B2 | 8/2011 | Udagawa et al. | 347/86 |
| 8,087,762 | B2 | 1/2012 | Takemura et al. | 347/85 |
| 8,205,974 | B2 | 6/2012 | Ogura et al. | 347/86 |
| 8,313,185 | B2 | 11/2012 | Hatasa et al. | 347/92 |
| 8,322,807 | B2 | 12/2012 | Seki et al. | 347/6 |
| 8,469,498 | B2 | 6/2013 | Ohashi et al. | 347/86 |
| 8,550,607 | B2 | 10/2013 | Inoue et al. | 347/86 |
| 9,333,758 | B2 | 5/2016 | Koshikawa et al. | B41J 2/1752 |
| 9,375,938 | B2 | 6/2016 | Kondo et al. | B41J 2/17513 |
| 9,597,884 | B2 | 3/2017 | Nanjo et al. | B41J 2/17526 |
| 9,738,081 | B2 | 8/2017 | Kimura et al. | B41J 2/175 |
| 9,821,562 | B2 | 11/2017 | Nanjo et al. | B41J 2/17523 |
| 9,840,082 | B2 | 12/2017 | Nanjo et al. | B41J 2/17513 |
| 9,908,338 | B2 | 3/2018 | Koshikawa et al. | B41J 2/17559 |
| 9,914,308 | B2 | 3/2018 | Yamada et al. | B41J 2/1404 |
| 9,975,340 | B2 | 5/2018 | Karita et al. | B41J 2/14024 |
| 9,981,464 | B2 | 5/2018 | Karita et al. | B41J 2/155 |
| 10,005,287 | B2 | 6/2018 | Yamada et al. | B41J 2/14072 |
| 10,029,474 | B2 | 7/2018 | Takada et al. | B01D 19/0073 |
| 10,118,396 | B2 | 11/2018 | Kimura et al. | B41J 29/377 |
| 10,195,868 | B2 | 2/2019 | Yamada et al. | B41J 2/175 |
| 10,207,511 | B2 | 2/2019 | Nanjo et al. | B41J 2/175 |
| 10,471,711 | B2 | 11/2019 | Karita et al. | B41J 2/16585 |
| 10,618,293 | B2 | 4/2020 | Koshikawa et al. | G03G 15/0886 |
| 10,906,323 | B2 | 2/2021 | Nagaoka et al. | B41J 2/17553 |
| 10,994,548 | B2 | 5/2021 | Iinuma et al. | B41J 2/175 |
| 2002/0113853 | A1 | 8/2002 | Hattori et al. | 347/86 |
| 2003/0043241 | A1 | 3/2003 | Hattori et al. | 347/86 |
| 2009/0278900 | A1 | 11/2009 | Kondo et al. | 347/85 |
| 2013/0050310 | A1 | 2/2013 | Seki et al. | 347/6 |
| 2014/0292958 | A1 | 10/2014 | Tomoguchi et al. | B41J 2/175 |
| 2017/0197426 | A1 | 7/2017 | Nagai et al. | B41J 2/1404 |
| 2017/0355191 | A1 | 12/2017 | Mizutani et al. | B41J 2/1754 |
| 2017/0355194 | A1 | 12/2017 | Fukasawa et al. | B41J 2/1754 |
| 2017/0355197 | A1 | 12/2017 | Kudo et al. | B41J 2/17513 |
| 2018/0250943 | A1 | 9/2018 | Fukasawa et al. | B41J 2/17509 |
| 2019/0030903 | A1 | 1/2019 | Fukasawa et al. | B41J 29/02 |
| 2019/0061359 | A1 | 2/2019 | Duca et al. | B41J 2/175 |
| 2019/0381799 | A1 | 12/2019 | Ueno | B41J 2/17596 |
| 2020/0101750 | A1 | 4/2020 | Nagaoka et al. | B41J 2/17523 |
| 2020/0282729 | A1 | 9/2020 | Inoue et al. | B41J 2/175 |
| 2020/0316973 | A1 | 10/2020 | Toki et al. | B41J 2/17523 |
| 2021/0323755 | A1 | 10/2021 | Sugawara et al. | B65D 83/384 |

FOREIGN PATENT DOCUMENTS

| | | |
|---|---|---|
| CN | 107487084 | 12/2017 |
| CN | 108136788 | 6/2018 |
| CN | 108528045 | 9/2018 |
| CN | 109318598 | 2/2019 |
| CN | 110605916 | 12/2019 |
| CN | 110962465 | 4/2020 |
| EP | 3628497 | 4/2020 |
| JP | 2014-213565 | 11/2014 |
| JP | 2018-095277 | 6/2018 |
| JP | 2018-144240 | 9/2018 |
| JP | 2020-019570 | 2/2020 |
| WO | 2020/017617 | 1/2020 |

OTHER PUBLICATIONS

U.S. Appl. No. 17/370,955, filed Jul. 8, 2021.
U.S. Appl. No. 17/272,588, filed Mar. 1, 2021.
U.S. Appl. No. 17/272,600, filed Mar. 1, 2021.
U.S. Appl. No. 17/357,665, filed Jun. 24, 2021.
U.S. Appl. No. 17/375,541, filed Jul. 14, 2021.
Extended European Search Report dated Dec. 13, 2021 in counterpart EP Application No. 21185107.6.
Office Action dated Nov. 23, 2022 in counterpart Chinese Application No. 202110787384.6, together with English translation thereof.

* cited by examiner

LIQUID STORAGE CONTAINER

BACKGROUND OF THE DISCLOSURE

Field of the Disclosure

The present disclosure relates to a liquid storage container configured to store liquid.

Description of the Related Art

Among liquid tanks used in liquid ejecting apparatuses such as inkjet printing apparatuses, there is a liquid tank that can be replenished with liquid. For example, by using a liquid storage container including a discharge port for pouring the liquid, the liquid tank can be replenished with the liquid from the liquid storage container through the discharge port. In this type of liquid storage container, in order to prevent smearing of the surroundings and the hand of a user, a valve with a slit is provided at a front end of the discharge port, and leakage of the liquid is thereby forcedly stopped (see Japanese Patent Laid-Open No. 2018-95277 (hereinafter, referred to as Document 1)).

Document 1 describes a container which includes a discharge port main body and a cover capable of opening and closing the discharge port by covering it and in which a valve with a slit is provided inside the discharge port main body. Document 1 describes a configuration in which the discharge port is sealed with the cover before the cover is completely closed, and then, completely closing the cover causes a protrusion formed in the cover to be inserted into the valve and open the slit portion of the valve.

In the configuration described in Document 1, just after the cover starts to open, the protrusion moves away from the valve, and the valve is thereby closed. Thus, the sealing of the liquid storage container is maintained in the case where the cover is opened. With this configuration, in the case where the air pressure inside the liquid storage container is higher than the outside air pressure, there is a possibility that the liquid sprays out of the liquid storage container on opening the valve to replenish the liquid tank with the liquid from the liquid storage container. Moreover, there is a possibility that, in the case where the liquid storage container is tilted such that the discharge part is directed downward, the hydraulic head difference of the liquid in the liquid storage container acting on the valve exceeds the withstanding pressure of the valve and opens the valve, causing the liquid to spray out. The spraying-out liquid may directly reach the outside of the liquid storage container.

SUMMARY OF THE DISCLOSURE

A liquid storage container according one aspect of the present disclosure includes: a discharge port member including a discharge port through which liquid stored in a storage portion is discharged; a cover portion configured to be attachable to and detachable from the discharge port member and to be capable of opening and closing the discharge port; a liquid stop valve provided inside the discharge port member; and a protrusion provided inside the cover portion and configured to open the liquid stop valve in closing the cover portion, in which the storage portion is sealable by at least one of a first sealing portion formed of a contact portion between the cover portion and the discharge port member and a second sealing portion formed of the liquid stop valve, and the first sealing portion and the second sealing portion are configured to be simultaneously unsealed.

Further features of the present disclosure will become apparent from the following description of exemplary embodiments with reference to the attached drawings.

DESCRIPTION OF THE EMBODIMENTS

Figure 1:
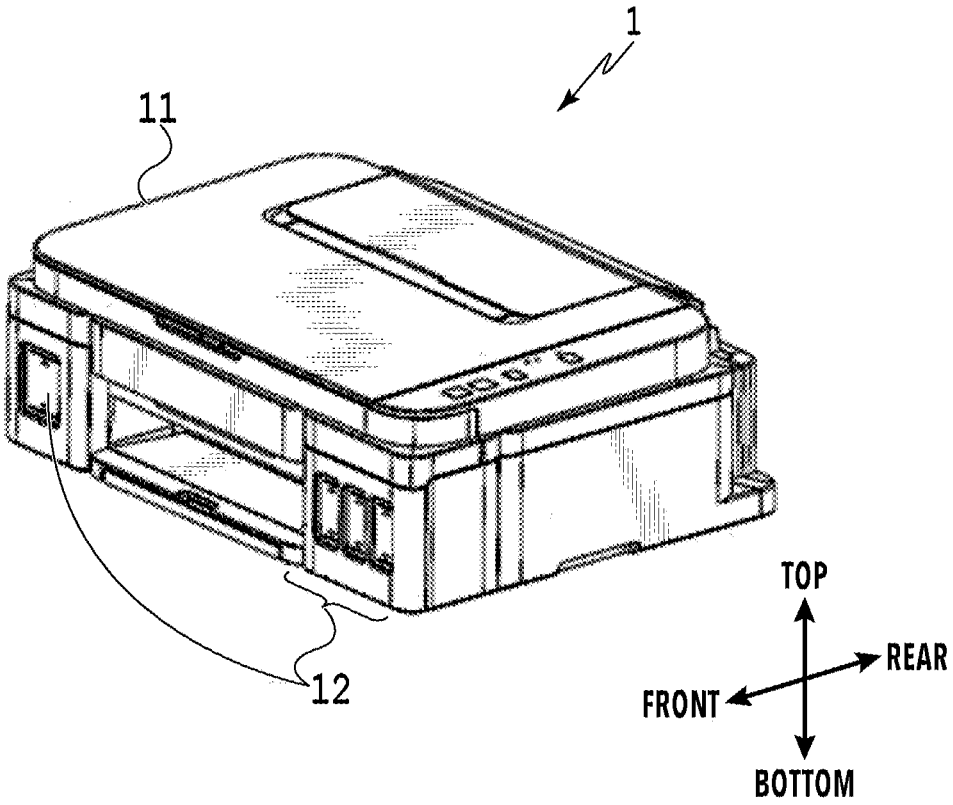
FIG. 1 is a perspective view of an outer appearance of a liquid ejecting apparatus.

Embodiments are described below with reference to the drawings. Note that the same configurations in the description are denoted by the same reference numerals. Moreover, the arrangement of constituent elements relative to one another, the shapes of the constituent elements, and the like that are described in the embodiments are merely examples.

First Embodiment

FIG. 1 is a perspective view of an outer appearance of a liquid ejecting apparatus 1 in the embodiment. The liquid ejecting apparatus 1 illustrated in FIG. 1 is a serial inkjet printing apparatus. The liquid ejecting apparatus 1 illustrated in FIG. 1 includes a case 11 and liquid tanks 12 arranged inside the case 11. Each liquid tank 12 stores an ink that is liquid to be ejected to a print medium (not illustrated).

Figure 2:
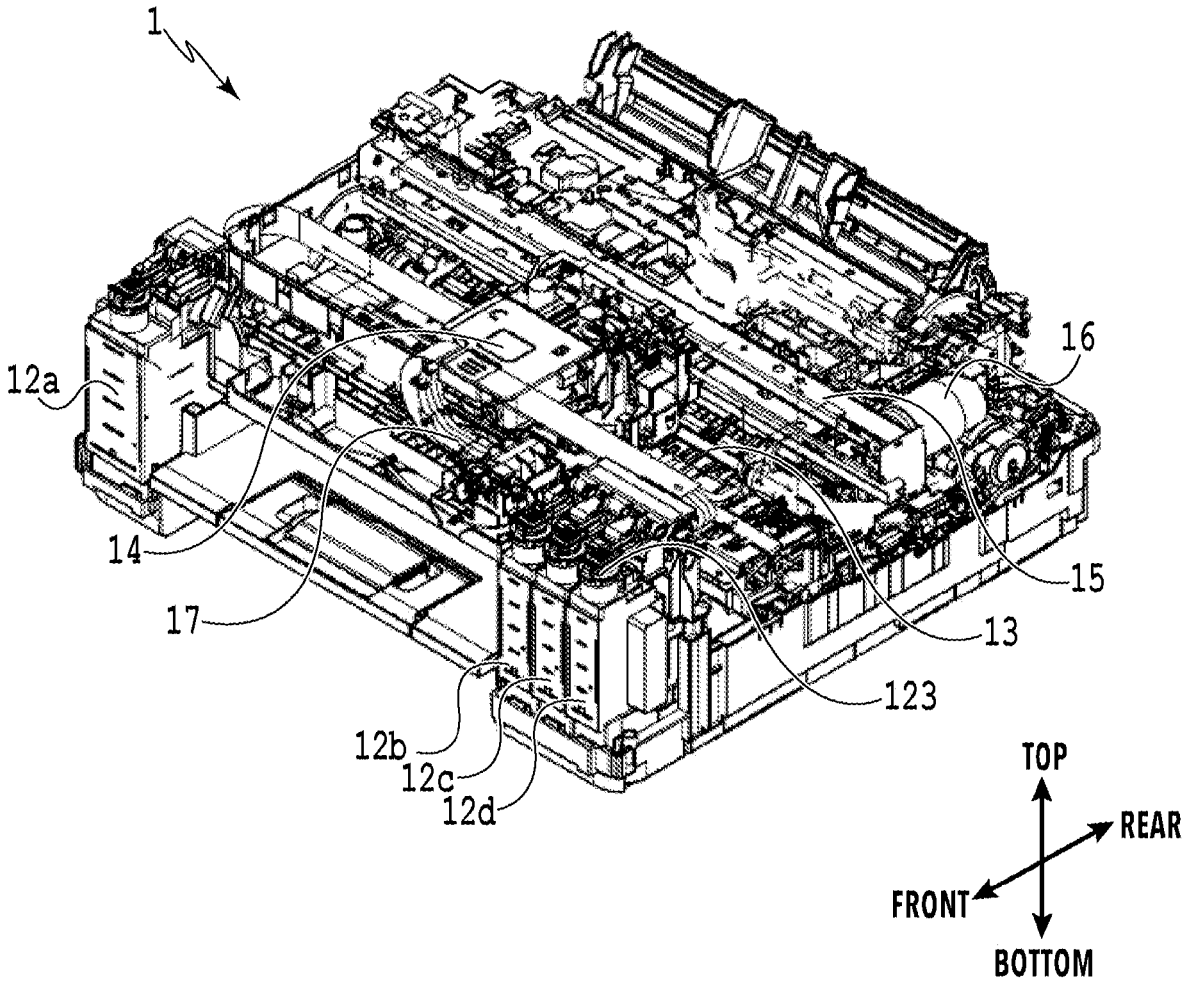
FIG. 2 is a perspective view of an internal configuration of the liquid ejecting apparatus.

FIG. 2 is a perspective view of an internal configuration of the liquid ejecting apparatus 1 illustrated in FIG. 1. In FIG. 2, the liquid ejecting apparatus 1 includes a conveyance roller 13 used to convey the print medium (not illustrated), a carriage 15 provided with a print head 14 configured to eject the liquid, and a carriage motor 16 used to drive the carriage 15. The print medium is not limited to a particular medium as long as an image can be formed on the medium with the liquid ejected from the print head 14. For example, paper, cloth, the label surfaces of optical discs, plastic sheets, OHP sheets or the like can be given as print media.

The liquid is stored in the liquid tanks 12 and is supplied to the print head 14 via a liquid distribution passage 17 to be ejected from the print head 14. In the embodiment, inks of four colors (for example, cyan, magenta, yellow, and black) are used as the liquid, and four liquid tanks 12*a* to 12*d* for the respective colors that store the inks of the respective colors are provided as the liquid tanks 12. In the following description, in the case where the individual liquid tanks, distinguished from one another, are referred, alphabets are added at the ends, for example, liquid tanks 12*a* to 12*d*. In the case where any one of the liquid tanks is referred to, the liquid tank is referred to as the liquid tank 12. The liquid tanks 12*a* to 12*d* for the respective colors are arranged in a front face portion of the liquid ejecting apparatus 1 inside the case 11.

Figure 3A:
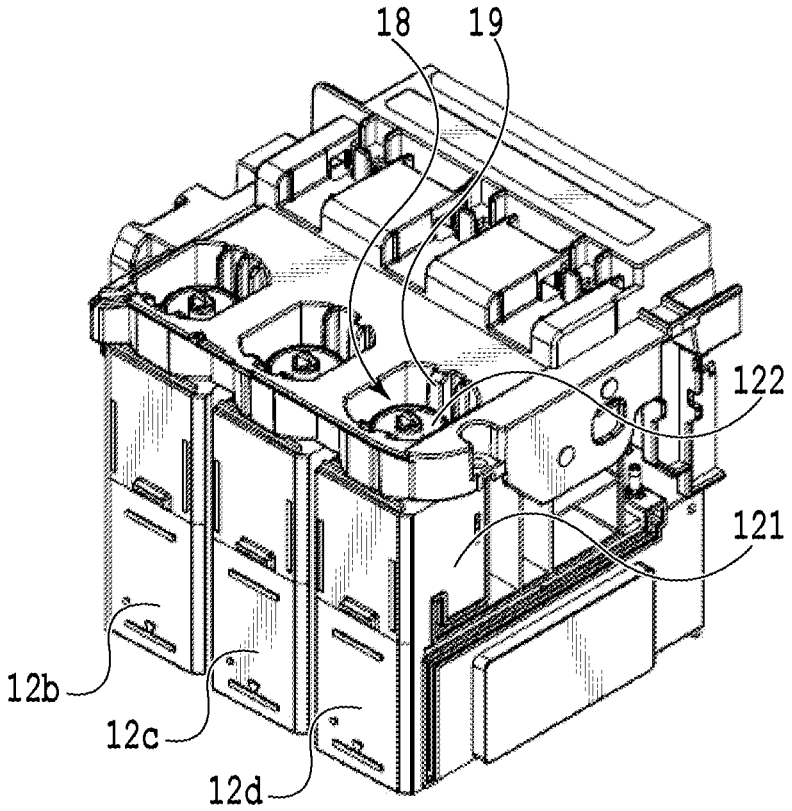
FIGS. 3A and 3B are an enlarged perspective view and plan view of a portion of the liquid ejecting apparatus in which liquid tanks are housed.
Figure 3B:
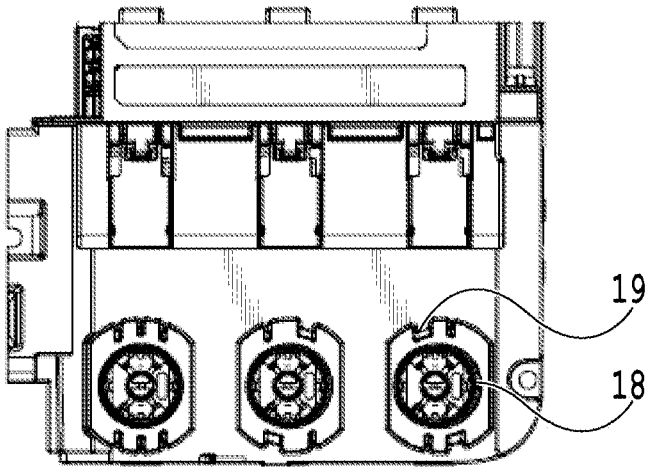

FIG. 3A is an example of an enlarged perspective view of a portion of the liquid ejecting apparatus 1 illustrated in FIG. 1 in which the liquid tanks 12*b* to 12*d* are housed, and FIG. 3B is a plan view corresponding to the perspective view illustrated in FIG. 3A. Each liquid tank 12 includes a liquid tank main body 121 used to store the liquid and a communication flow passage 122 communicating with a liquid storage chamber in the liquid tank main body 121. The liquid tank 12 includes a tank cover 123 (see FIG. 2) configured to be attachable to cover the communication flow passage 122 and seal the storage chamber in the liquid tank main body 121 in occasions other than an occasion of liquid replenishment. In the case where the liquid tank 12 is replenished with the liquid, a discharge port of a liquid storage container 2 (see FIG. 4) is inserted into the communication flow passage 122 and the liquid is poured into the liquid tank 12. The liquid storage chamber is sealed with the tank cover 123 in occasions other than the occasion of liquid replenishment, and thus it is possible to reduce evaporation of the liquid in the liquid tank 12. The communication flow passage 122 includes two flow passages extending parallel to each other in the vertical direction in an interior thereof and is configured to allow the liquid in the liquid storage container 2 to be poured into the liquid tank by means of gas-liquid exchange. A socket 18 is provided in a portion of the liquid ejecting apparatus 1 where the discharge port of the liquid storage container 2 is to be inserted. The socket 18 is provided with protruding portions 19 protruding inward from an inner peripheral wall of the socket 18. The socket 18 is provided for each liquid tank 12, and the shapes of the protruding portions 19 vary among the sockets 18 to suppress erroneous insertion of the liquid container. The protruding portions 19 are rotationally symmetric by 180° with respect to the center axis of the communication flow passage 122.

Figure 4:
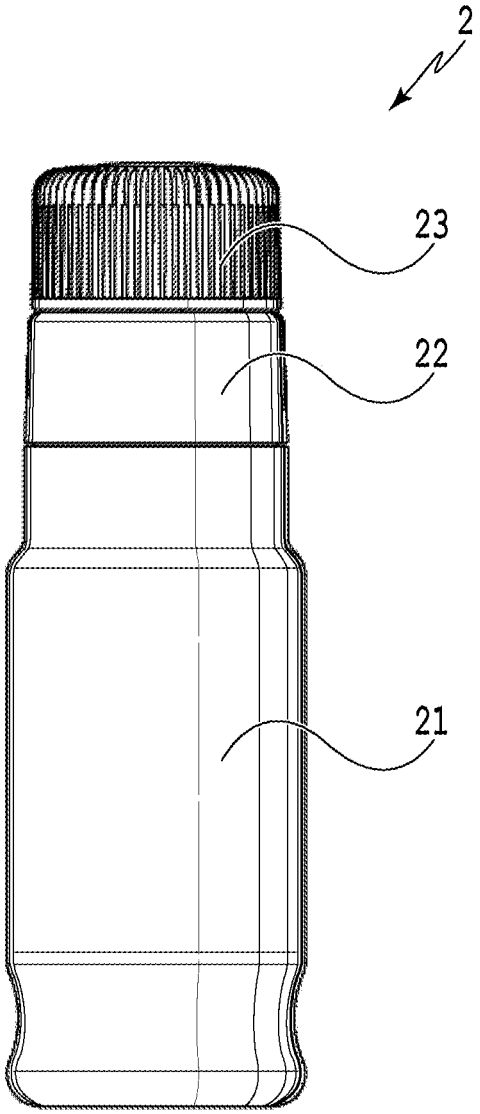
FIG. 4 is an outer appearance view of a liquid storage container.

FIG. 4 is an elevation view of an outer appearance of the liquid storage container 2 which is a liquid container used to replenish the liquid tank 12 with the liquid. The liquid storage container 2 in FIG. 4 includes a bottle 21 that is a storage portion (main body portion) configured to store the liquid, a nozzle 22 coupled to the bottle 21, and a cap 23 attachable to and detachable from the nozzle 22. The nozzle 22 is a discharge port member having a function of an outlet for the case where the liquid stored in the bottle 21 is discharged. The cap 23 is a cover portion that is attached to the nozzle 22 to shield the interior of the liquid storage container 2 (specifically, the bottle 21) from the outside air. Methods of coupling the bottle 21 and the nozzle 22 to each other include a method of sealing a space between the bottle 21 and the nozzle 22 by inserting a flexible part, a method of forming both of the bottle 21 and the nozzle 22 with resin parts and welding the two parts together, and the like. The bottle 21 and the nozzle 22 may be an integral part.

Figure 5A:
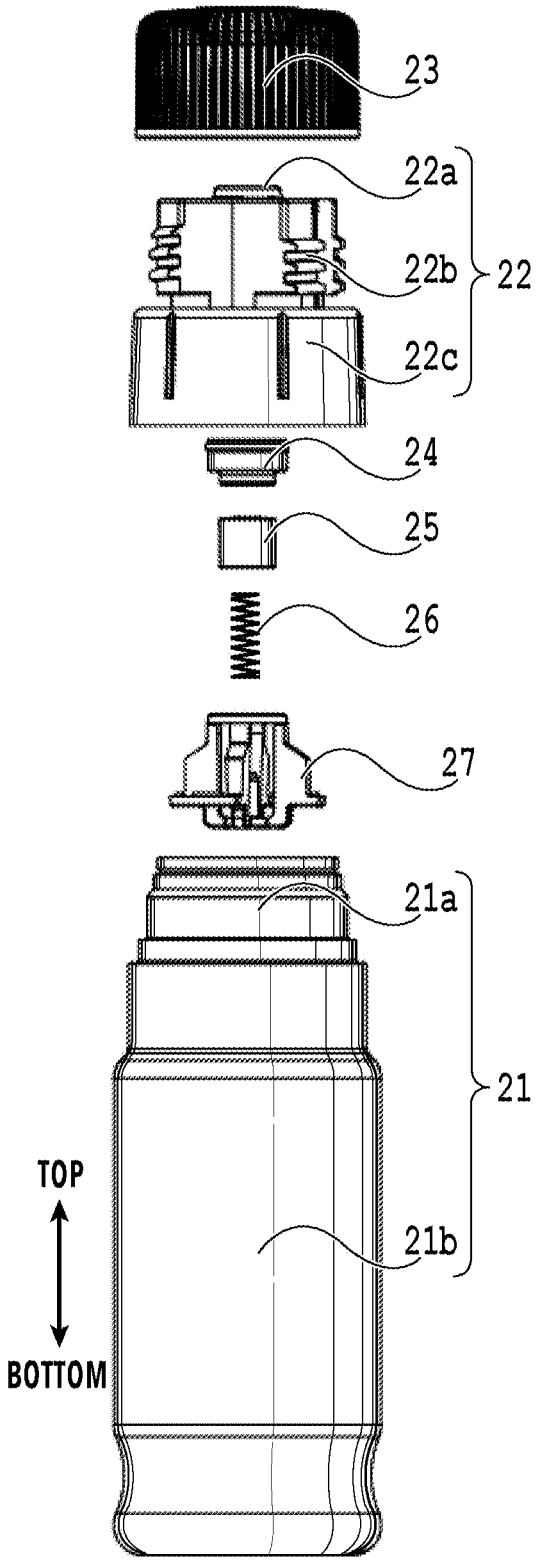
FIGS. 5A and 5B are a part configuration view and cross-sectional view of the liquid storage container.
Figure 5B:
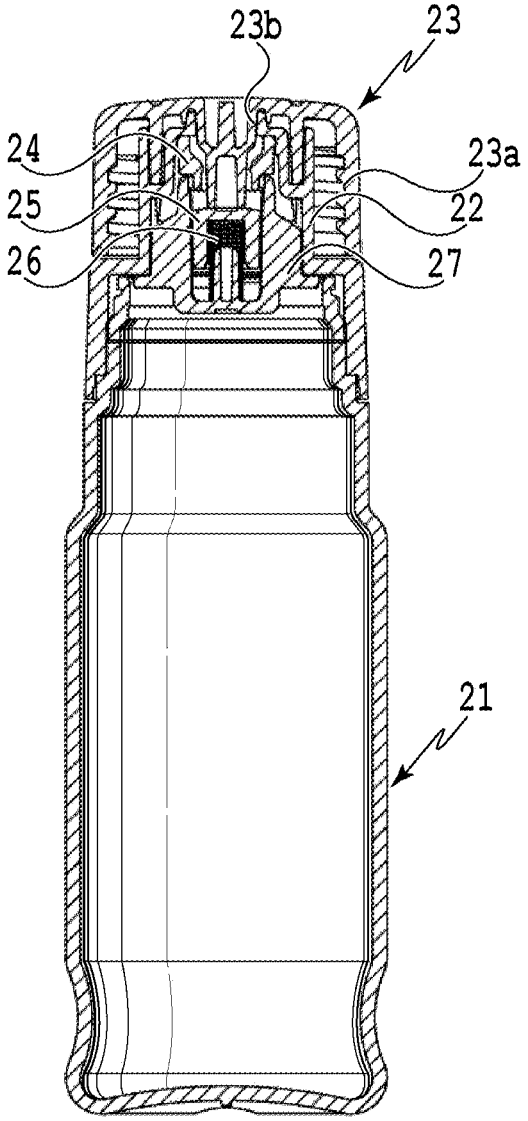

FIG. 5A illustrates an example of a part configuration view of the liquid storage container 2 illustrated in FIG. 4. FIG. 5B is a cross-sectional view in which the parts in the part configuration view of the liquid storage container 2 illustrated in FIG. 5A are coupled to one another. The bottle 21 of the liquid storage container 2 includes a bottle welding portion 21*a* formed in an upper portion and a liquid storage portion 21*b* formed in a lower portion. The nozzle 22 includes a discharge port 22*a* through which the liquid is discharged, a nozzle thread portion 22*b* in which a male thread structure is formed on the outside, and a nozzle welding portion 22*c* in which a welding surface is formed on the inside or a bottom surface. The cap 23, which is the cover portion, is configured to be attachable to and detachable from the nozzle 22, which is the discharge port member, and can open and close the discharge port 22*a*. Polyethylene (PE), polypropylene (PP), and the like can be given as examples of the material forming the bottle 21. Polyethylene (PE), polypropylene (PP), and the like can be given as the material forming the nozzle 22. The nozzle 22 is joined to the bottle 21 by welding the nozzle welding portion 22*c* to the bottle welding portion 21*a*. In the case where the bottle 21 and the nozzle 22 are joined by being welded to each other, the bottle 21 and the nozzle 22 are preferably made of the same type of material. A seal 24 having an opening, a valve 25 configured to open and close the opening of the seal 24, a spring 26 configured to bias the valve 25, and a holder 27 configured to fix the spring 26 are included inside the nozzle 22.

In the case where the liquid is supplied from the liquid storage container 2 to the liquid tank 12, the communication flow passage 122 of the liquid tank 12 is inserted into an opening of the nozzle 22 of the liquid storage container 2. The nozzle 22 of the liquid storage container 2 is provided with recess portions configured to engage with the protruding portions 19 of the socket 18 in the liquid ejecting apparatus 1, and the liquid storage container 2 is aligned in the case where the communication flow passage 122 is inserted into the opening of the nozzle 22. Then, the liquid in the liquid storage container 2 is supplied to the storage chamber of the liquid tank main body 121 via the communication flow passage 122 by means of hydraulic head difference.

Figure 6A:
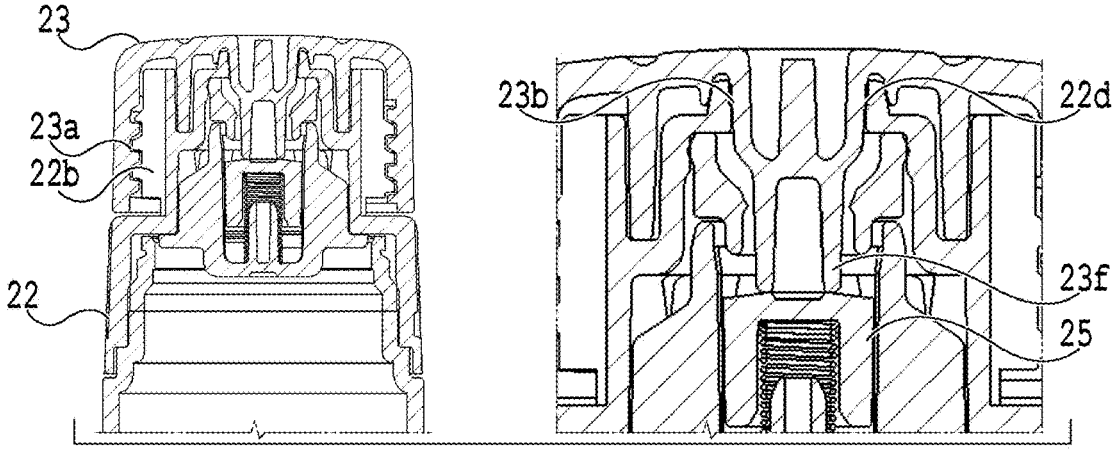
FIGS. 6A to 6C are explanatory views of sealing portions.
Figure 6B:
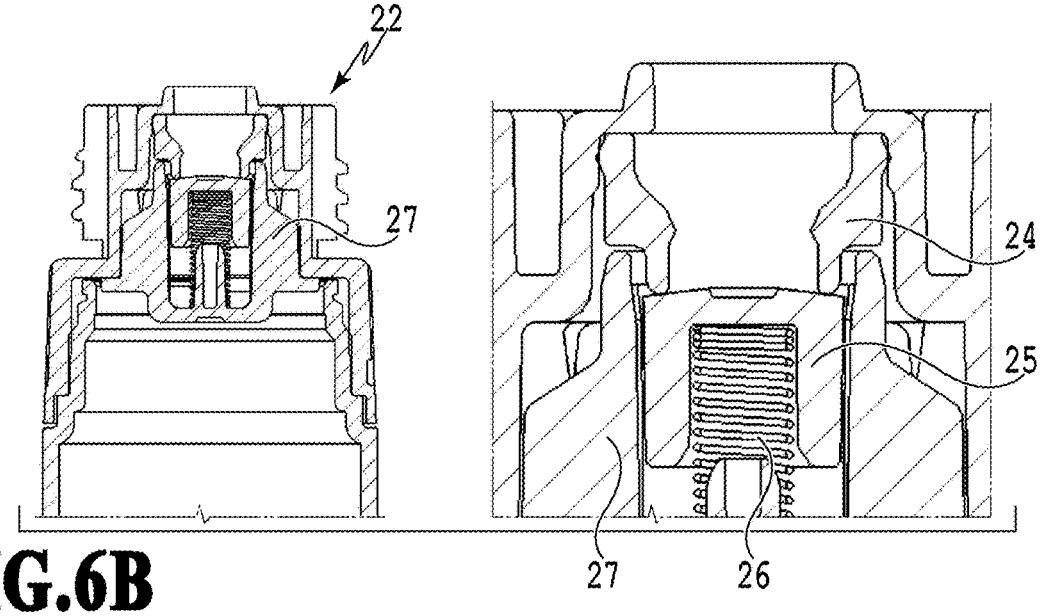
Figure 6C:
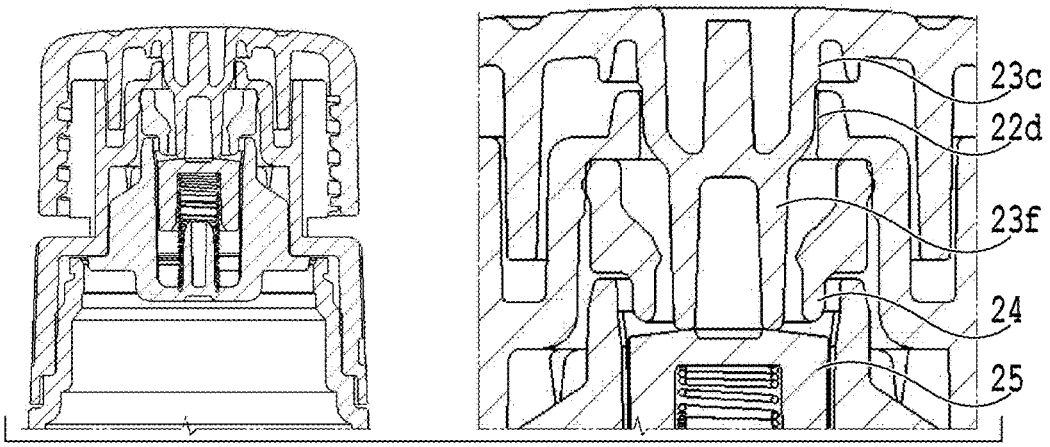

The liquid storage container 2 includes two sealable portions (hereinafter, referred to as sealing portions). FIGS. 6A to 6C are explanatory views of the sealing portions. As illustrated in FIG. 6A, in a first sealing portion, sealing is achieved by fitting the cap 23 to the nozzle 22. As illustrated in FIG. 6B, in a second sealing portion, sealing is achieved by a valve structure in the nozzle 22. The sealing portions are described below.

The first sealing portion is described with reference to FIG. 6A. FIG. 6A is a cross-sectional view of an upper portion of the liquid storage container 2 in a state where the cap 23 is attached to the nozzle 22, and also illustrates an enlarged view of the upper portion. The first sealing portion is a portion in which a cap sealing portion 23*b* of the cap 23 is fitted to a nozzle sealing portion 22*d* that is part of the discharge port 22*a* of the nozzle 22 by attaching the cap 23 to the nozzle 22. As an example of a method of attaching the cap 23 to the nozzle 22, there is a method of screwing the cap 23 to the nozzle 22. Specifically, as illustrated in FIGS. 5A, 5B, and 6A, there is a method of screwing the cap 23 to the nozzle 22 by using the nozzle thread portion 22*b* in which the male thread structure is formed on the outside of the nozzle 22 and a cap thread portion 23*a* in which a female thread structure is formed on the inside of a lower portion of the cap 23. Conversely, the attachment may be achieved by using a cap 23 in which a male thread portion is formed and a nozzle 22 in which a female thread portion is formed.

Moreover, as the method of attaching the cap 23 to the nozzle 22, instead of screwing, a fitting portion other than the sealing portion may be provided. For example, there may be employed a configuration such as an externally-fitted cover in which a cap 23 is fitted to the outside of a nozzle 22 or an internally-fitted cover in which a cap 23 is fitted to the inside of a nozzle 22.

The second sealing portion is described with reference to FIG. 6B. FIG. 6B is a cross-sectional view of the upper portion of the liquid storage container 2 in a state where no cap 23 is attached, and also illustrates an enlarged view of the upper portion. The second sealing portion is a portion of a liquid stop valve structure (valve structure) arranged inside the nozzle 22 of the liquid storage container 2. As illustrated in FIG. 6B, the seal 24 which is an orifice portion having an opening into which the communication flow passage 122 is to be inserted is arranged in a front end (upper end) of the nozzle 22. Then, the valve 25, which is a valve element of the liquid stop valve, is biased toward the opening with the spring 26, thereby the gap between the seal 24 and the valve 25 is closed, and the liquid storage container 2 is sealed. In the embodiment, the spring 26 is used as a biasing mechanism, and the holder 27 fixed in an inner space of the nozzle 22 holds the spring 26. The seal 24 is formed of a flexible member made of rubber, elastomer, or the like.

Since the valve 25 is biased toward the opening of the seal 24 with the spring 26, the liquid stop valve structure can maintain the interior of the liquid storage container 2 in the sealed state in the state where the cap 23 is removed from the nozzle 22. In the case where the liquid is supplied from the liquid storage container 2 to the liquid tank 12, the communication flow passage 122 is inserted into the nozzle 22 through the opening of the seal 24, thereby opening the valve 25. Then, as described above, the liquid in the liquid storage container 2 is supplied to the storage chamber of the liquid tank main body 121 via the communication flow passage 122 by means of hydraulic head difference.

In the embodiment, the two sealing portions are configured to be temporarily simultaneously unsealed in cap-opening in which the cap 23 is removed from nozzle 22 and in cap-closing in which the cap is attached to the nozzle 22. This configuration allows the interior of the liquid storage container 2 to communicate with the atmosphere and can equalize the pressure inside the liquid storage container 2 with the outside air pressure. Details are described below.

As illustrated in FIG. 6A, in the state where the cap 23 is closed, the first sealing portion is in a sealed state. Meanwhile, in the second sealing portion, a protrusion 23*f* arranged in the cap 23 is pushed in a direction opposite to the biasing direction of the valve 25 with the closing of the cap 23, and a gap is thereby formed between the seal 24 and the valve 25. As described above, in FIG. 6A, the second sealing portion is in an unsealed state. Specifically, in the closed state of the cap 23, the first sealing portion is sealed, and the second sealing portion is unsealed.

FIG. 6C is a cross-sectional view of an upper portion of the liquid storage container 2 in a state where the cap 23 has started to be opened from the state where the cap 23 is attached to the nozzle 22 illustrated in FIG. 6A, and also illustrates an enlarged view of the upper portion. The cap 23 moves upward from the closed state illustrated in FIG. 6A along with the cap-opening as illustrated in FIG. 6C. The cap sealing portion 23*b* and the nozzle sealing portion 22*d* separate from each other along with this movement of the cap 23, and the first sealing portion is unsealed. In the unsealing of the first sealing portion, the protrusion 23*f* arranged in the cap 23 is still at such a position that the protrusion 23*f* pushes the valve 25 as illustrated in FIG. 6C. Specifically, the unsealed state of the second sealing portion is maintained. Accordingly, as illustrated in FIG. 6C, the second sealing portion and the first sealing portion can be simultaneously unsealed in unsealing the first sealing portion. Then, in the case where the cap 23 is further moved upward, the protrusion 23*f* completely separates from the valve 25 along with the movement of the cap 23, and as illustrated in FIG. 6B, the second sealing portion is sealed. Note that, also in the case where the cap 23 is closed from the open state, the protrusion 23*f* of the cap 23 pushes the valve 25 along with the movement of the cap 23, and the second sealing portion is unsealed. In this case, since the first sealing portion is in a pre-sealed state, the unsealed state of the first sealing portion is maintained. Then, setting the cap 23 to the closed state sets the first sealing portion to the sealed state. Note that the first sealing portion and the second sealing portion are simultaneously unsealed means that the first sealing portion and the second sealing portion are substantially simultaneously unsealed. In the case where unsealing of the first sealing portion causes the second sealing portion to be unsealed in conjunction, it means that both sealing portions are simultaneously unsealed.

Since the above configuration temporarily simultaneously sets the first sealing portion and the second sealing portion to the unsealed state in opening the cap 23, this configuration allows the interior of the liquid storage container 2 to communicate with the atmosphere and can equalize the pressure in the liquid storage container 2 with the outside air pressure. Accordingly, the occurrence of spraying-out of the liquid due to an increase in the internal pressure of the liquid storage container 2 can be suppressed in the case where the cap 23 is opened and the liquid tank main body 121 is replenished with the liquid from the liquid storage container 2. Moreover, it is possible to suppress the occurrence of overflow of the liquid from the liquid tank main body 121. Furthermore, since the second sealing portion maintains the interior of the liquid storage container 2 in the sealed state after the cap 23 is opened, the occurrence of leakage of the liquid can be suppressed even if the liquid storage container 2 is turned upside down.

As a sealing method of the two sealing portions described above, there are a method of achieving sealing by pressing a rigid material and a flexible material such as rubber or elastomer against each other, a method of achieving sealing by fitting rigid materials to each other, and the like.

In the embodiment, there is employed a method in which a rigid material such as polyethylene (PE) or polypropylene (PP) is used for the nozzle 22 and the cap 23 in the first sealing portion, and these parts are configured to be fitted to each other. In the first sealing portion, two parts made of the same material may be fitted to be in contact with each other, or two parts varying in physical property may be brought into contact with each other. A flexible material such as rubber or elastomer is used as the material forming the seal 24 in the second sealing portion. A rigid material such as polyethylene (PE) or polypropylene (PP) is used as the material forming the valve 25 in the second sealing portion. Then, there is employed a method of achieving sealing by pressing the seal 24 and the valve 25 against each other.

Figure 7:
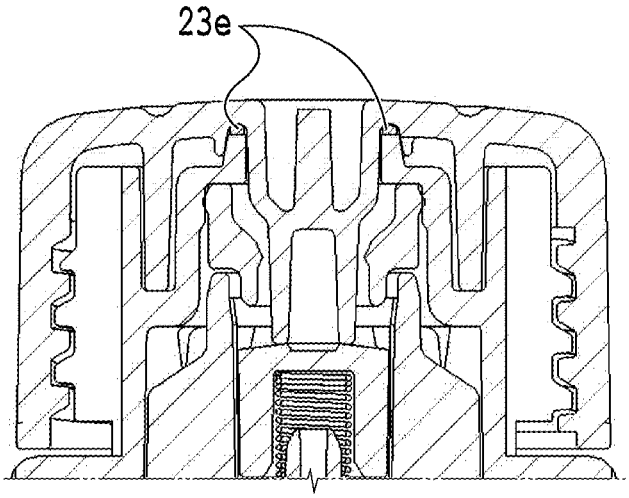
FIG. 7 is a view of another sealing method for the sealing portions.
Figure 8:
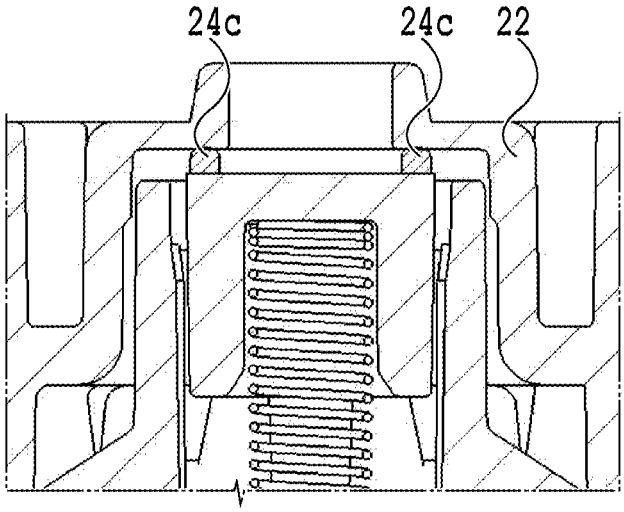
FIG. 8 is a view of another sealing method for the sealing portions.

FIG. 7 is a view of another sealing method for the first sealing portion. As illustrated in FIG. 7, the first sealing portion may employ a method in which a flexible material 23*e* is used in one of the nozzle 22 or the cap 23, and sealing is achieved by pressing the flexible material 23*e* against the other part. FIG. 8 is a view of another sealing method for the second sealing portion. As illustrated in FIG. 8, the second sealing portion may employ a method in which a flexible material 24*c* is used in the valve 25 and sealing is achieved by pressing the material 24*c* against the nozzle 22 for which a rigid material is used.

Figure 9A:
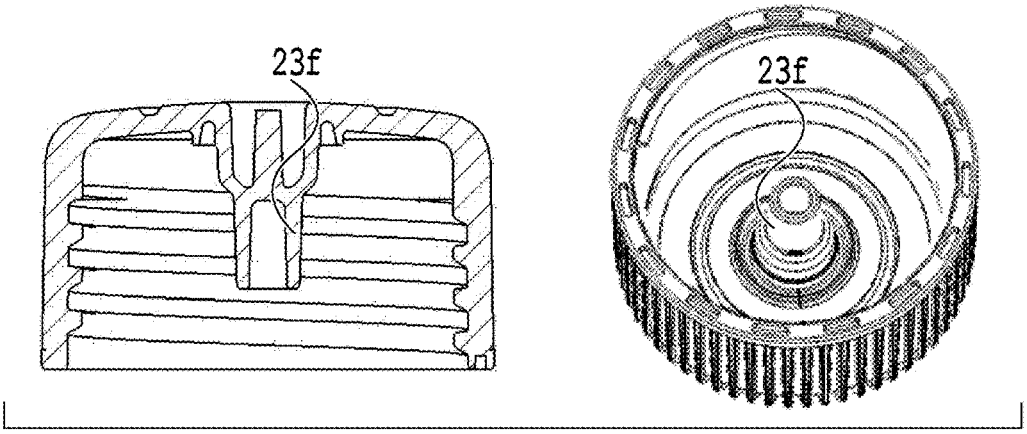
FIGS. 9A to 9C are views of various examples of protrusions configured to push a valve.
Figure 9B:
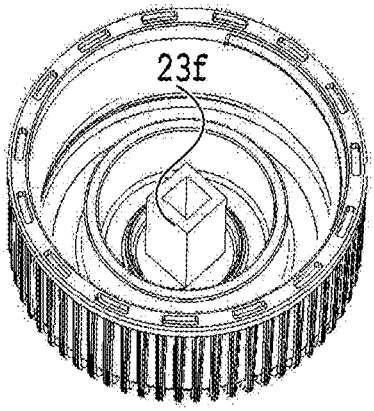
Figure 9C:
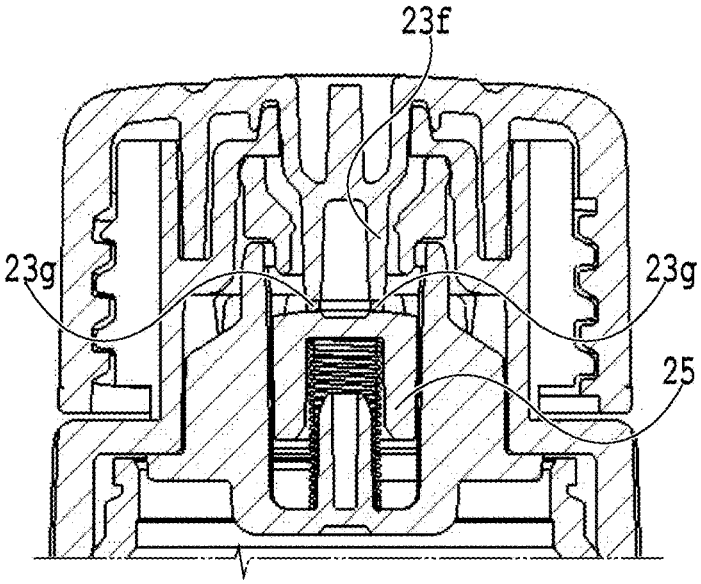

FIGS. 9A to 9C are views of various types of protrusions 23*f* configured to push the valve 25. The shape of the protrusion 23*f* arranged in the cap 23 and configured to push the valve 25 is preferably such a shape that the distal end of the protrusion forms a surface extending in directions perpendicular to the moving direction of the valve 25 and can push the valve 25 without causing the valve 25 to tilt. For example, the protrusion 23*f* may have a cylindrical shape such as a columnar shape or a conical shape as illustrated in FIG. 9A or a polygonal shape such as a polygonal prism shape or a polygonal pyramid shape as illustrated in FIG. 9B.

Moreover, as illustrated in FIG. 9C, a flexible material 23*g* may be used in the distal end of the protrusion 23*f*. Using the flexible material 23*g* can suppress deformation of the valve 25 in the case where the protrusion 23*f* comes into contact with the valve 25.

Stainless steel (SUS) and the like can be given as the material forming the spring 26. Polyethylene (PE), polypropylene (PP), and the like can be given as the material forming the holder 27. As a method of fixing the holder 27 to the nozzle 22, it is preferable to form the holder 27 and the nozzle 22 by using the same material and welding the holder 27 and the nozzle 22 to each other.

As described above, in the embodiment, in opening and closing the cap 23, the state where the valve 25 is opened by the protrusion 23*f* of the cap 23 occurs while the cap 23 and the nozzle 22 are not sealed. Specifically, the state where the first sealing portion and the second sealing portion are temporarily simultaneously unsealed occurs. Accordingly, it is possible to cause the interior of the liquid storage container 2 to communicate with the atmosphere and equalize the pressure in the liquid storage container 2 with the outside air pressure. This can suppress the occurrence of overflow in the liquid tank 12 due to spraying-out of the liquid in the case where the liquid tank 12 is replenished with the liquid from the liquid storage container 2. Moreover, it is possible to suppress the occurrence of spraying-out of the liquid that would occur in the case where the liquid storage container 2 is tilted.

Second Embodiment

In the first embodiment, a description is given of the example in which the pressure in the liquid storage container 2 is released by employing the configuration in which the two sealing portions are temporarily simultaneously unsealed in opening and closing the cap 23. Simultaneously unsealing the two sealing portions can suppress the occurrence of spraying-out of the liquid in the liquid storage container 2. However, simultaneously unsealing the two sealing portions may sometimes cause droplets of the liquid in the liquid storage container 2 to come out. In the present embodiment, a description is given of an example of suppressing the occurrence of the case where the liquid in the liquid storage container 2 turns into droplets and scatters to the outside of the container. The basic configuration of the liquid storage container 2 is the same as that in the first embodiment, and description thereof is omitted.

Figure 10A:
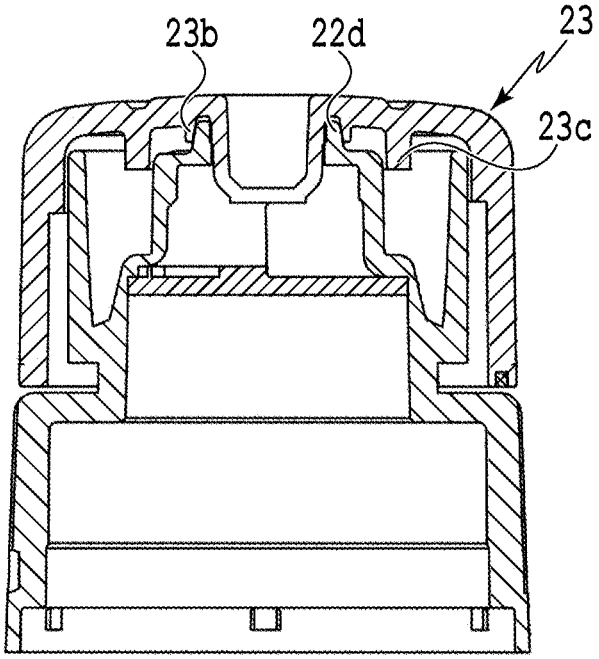
FIGS. 10A to 10C are explanatory views of a liquid storage container.
Figure 10B:
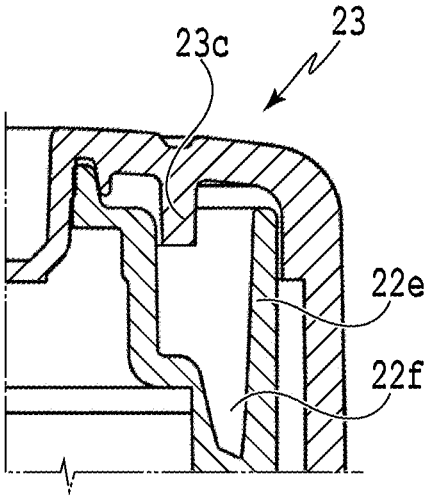
Figure 10C:
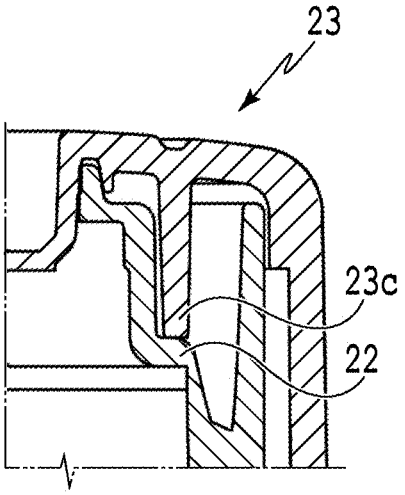

FIGS. 10A to 10C are explanatory views of the liquid storage container 2 of the embodiment. FIG. 10A is a cross-sectional view of the upper portion of the liquid storage container 2 in the state where the cap 23 is attached to the nozzle 22. As described in the first embodiment, the interior of the liquid storage container 2 is sealed by fitting the cap sealing portion 23*b* of the cap 23 to the nozzle sealing portion 22*d* of the nozzle 22. The cap sealing portion 23*b* has a rib shape, and the sealed state of the interior of the liquid storage container 2 is maintained by contact between the nozzle sealing portion 22*d* and the cap sealing portion 23*b* which is a rib. The rib forming the cap sealing portion 23*b* only needs to be in contact with the entire periphery of the nozzle sealing portion 22*d* and may have any shape. In the case where a thread shape is employed as a method of attaching the cap 23 to the nozzle 22, the shape of the rib is preferably a circular shape. Note that the portion of the cap sealing portion 23*b* to be in contact with the nozzle sealing portion 22*d* may be on the inside, the outside, or a ceiling surface of the nozzle sealing portion 22*d*. The cap sealing portion 23*b* may be in contact with the nozzle sealing portion 22*d* at these multiple portions, simultaneously.

Polypropylene (PP) or polyethylene (PE) is used as the materials of the cap 23 and the nozzle 22 in the embodiment. The same material or different materials may be used as a combination of the materials. Specifically, in the contact portion, two parts varying in physical property may be in contact with each other, or two parts made of the same material may be in contact with each other. In the case where the cap 23 and the nozzle 22 are assembled together at high speed, different materials are preferably used.

In the case where the sealed state is canceled with the outside air pressure being lower than the pressure inside the sealed space of the liquid storage container 2, gas and liquid contained in the interior of the liquid storage container 2 are guided to the outside. In the embodiment, as illustrated in FIG. 10A, the cap 23 includes a rib 23*c*. In the plan view of the cap 23, the rib 23*c* is provided outside the sealing portion (first sealing portion) formed of the cap sealing portion 23*b* and the nozzle sealing portion 22*d* as illustrated in FIG. 10A. The rib 23*c* is provided to surround the entire periphery of the sealing portion in the cap 23. In the embodiment, in opening the cap 23, the distal end position of the rib 23*c* of the cap 23 is located lower than the fitting position between the cap sealing portion 23*b* of the cap 23 and the nozzle sealing portion 22*d* of the nozzle 22. Accordingly, the rib 23*c* serves as a wall against the droplets of liquid generated at the moment of opening the cap 23 and can suppress the droplets being guided to the outside of the cap.

FIG. 10B is an enlarged view of FIG. 10A. The nozzle 22 includes a wall 22*e* protruding toward the cap 23. The wall 22*e* is provided outside the rib 23*c* of the cap 23 to surround the entire periphery of the rib 23*c*. Moreover, the nozzle 22 is provided with a groove 22*f* at a lower end of the wall 22*e*. This configuration causes the droplets scattering beyond the rib 23*c* to collide with the wall 22*e* and accumulate in the groove 22*f* Accordingly, it is possible to suppress scattering of the droplets to the outside of the liquid storage container 2.

FIG. 10C is a view of another example of the cap 23. As illustrated in FIG. 10C, the rib 23*c* of the cap 23 may be in contact with the nozzle 22. The configuration in which the distal end of the rib 23*c* extends to be closer to the storage portion (bottle 21) than in FIGS. 10A and 10B can increase the range in which the rib 23*c* receives the droplets. Moreover, the distal end of the rib 23*c* in the cap 23 functions as the reference position of the cap 23 with respect to the nozzle 22.

As described above, according to the embodiment, it is possible to suppress scattering of the droplets of the liquid in the liquid storage container 2 to the outside in opening the cap 23 to remove it from the nozzle 22.

OTHER EMBODIMENTS

Although the example in which the liquid storage container 2 includes two sealing portions of the first sealing portion and the second sealing portion is described in the first embodiment, the liquid storage container 2 may include three or more sealing portions. For example, the cap 23 may be an externally-fitted cover that fits on the outside of the nozzle 22 and an internally-fitted cover that fits on the inside of the nozzle 22. In any case, the liquid storage container 2 only needs to be configured such that the sealing portions are simultaneously unsealed in opening and closing the cap 23.

In the second embodiment, the example based on the liquid storage container 2 described in the first embodiment is described. Specifically, the liquid storage container 2 including the first sealing portion and the second sealing portion is described as an example. However, the liquid storage container 2 may be a liquid storage container including no second sealing portion.

Although the example in which the liquid storage container is used to replenish the liquid tank of the liquid ejecting apparatus with the liquid is described in the above embodiments, the liquid storage container may be a container used to replenish a liquid tank of any apparatus with liquid. Moreover, although the example in which the ink is used as the liquid stored in the liquid storage container is described, the liquid storage container may store any kind of liquid.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-122025, filed Jul. 16, 2020, which is hereby incorporated by reference wherein in its entirety.

What is claimed is:

1. A liquid storage container comprising:

a discharge port member including a discharge port through which liquid stored in a storage portion is discharged;

a cover portion configured to be attachable to and detachable from the discharge port member and to be capable of opening and closing the discharge port;

a liquid stop valve provided inside the discharge port member, wherein the liquid stop valve includes an orifice portion, a valve element, and a biasing mechanism configured to bias the valve element; and a protrusion provided inside the cover portion and configured to open the liquid stop valve in closing the cover portion, wherein the biasing mechanism closes a gap between the orifice portion and the valve element, wherein the gap is formed by the protrusion pushing the valve element, wherein unsealing of the liquid stop valve by the protrusion and unsealing by separation of the cover portion and the discharge port member simultaneously occur in opening the cover portion, wherein the storage portion is sealable by at least one of a first sealing portion formed of a contact portion between the cover portion and the discharge port member and a second sealing portion formed of the liquid stop valve, and wherein the first sealing portion and the second sealing portion are configured to be simultaneously unsealed.

2. The liquid storage container according to claim 1, wherein further opening the cover portion from a state where the first sealing portion and the second sealing portion are simultaneously unsealed causes the second sealing portion to be sealed.

3. The liquid storage container according to claim 1, wherein the orifice portion is formed of a flexible member.

4. The liquid storage container according to claim 1, wherein the cover portion and the discharge port member include thread structures, respectively, and the cover portion is attached to the discharge port member by the thread structures.

5. The liquid storage container according to claim 1, wherein the protrusion has a cylindrical shape.

6. The liquid storage container according to claim 1, wherein the protrusion has a polygonal shape.

7. The liquid storage container according to claim 1, wherein two parts varying in physical property are configured to be in contact with each other in at least one of the first sealing portion and the second sealing portion.

8. The liquid storage container according to claim 1, wherein two parts made of the same material are configured to be in contact with each other in at least one of the first sealing portion and the second sealing portion.

9. The liquid storage container according to claim 1, wherein a rib located outside the first sealing portion is included inside the cover portion.

10. The liquid storage container according to claim 1, further comprising a rib located outside the sealing portion and included inside the cover portion.

11. The liquid storage container according to claim 10, wherein the rib is formed to surround an entire periphery of the sealing portion inside the cover portion.

12. The liquid storage container according to claim 10, wherein a distal end of the rib is located on the storage portion side of the discharge port.

13. The liquid storage container according to claim 10, wherein the discharge port member includes a wall configured to surround the rib of the cover portion.

* * * * *